US007658699B1

(12) United States Patent
Johnson, Jr.

(10) Patent No.: US 7,658,699 B1
(45) Date of Patent: Feb. 9, 2010

(54) PUNCHING BAG ASSEMBLY

(76) Inventor: John R. Johnson, Jr., 21176 Serra Vista, Lake Forest, CA (US) 92630

( * ) Notice: Subject to any disclaimer, the term of this patent is extended or adjusted under 35 U.S.C. 154(b) by 0 days.

(21) Appl. No.: 12/052,133

(22) Filed: Mar. 20, 2008

(51) Int. Cl.
*A63B 69/22* (2006.01)
*A63B 69/34* (2006.01)

(52) U.S. Cl. ..... 482/87; 482/83

(58) Field of Classification Search ..... 482/83–90; 472/118; 473/447
See application file for complete search history.

(56) References Cited

U.S. PATENT DOCUMENTS 3,424,458 A * 1/1969 Hopps, Jr. ..... 473/443
6,348,028 B1 * 2/2002 Cragg ..... 482/148
6,530,867 B2 * 3/2003 Schwendemann ..... 482/83
6,758,794 B2 * 7/2004 Lee ..... 482/87
7,458,919 B2 * 12/2008 Giusti ..... 482/87
2003/0158017 A1 * 8/2003 Lee ..... 482/87
2005/0227825 A1 * 10/2005 Kutov ..... 482/83

* cited by examiner

*Primary Examiner*—Fenn C Mathew

(57) ABSTRACT

A punching bag assembly includes a support stand having a pair of spaced-apart leg assemblies and a support frame carried by the leg assemblies, a body punching bag assembly carried by the support frame and having a body punching bag and a speed bag assembly having a speed bag carried by the support frame generally adjacent to the body punching bag assembly. The body punching bag assembly and the speed bag assembly are selectively positional with respect to each other along the support frame.

6 Claims, 4 Drawing Sheets

PUNCHING BAG ASSEMBLY

FIELD

The present disclosure relates to recreational punching bags. More particularly, the present disclosure relates to a punching bag assembly having a height-adjustable and length-adjustable support frame and a positionally adjustable body punching bag and speed bag mounted on the support frame.

BACKGROUND

Recreational punching bags used for boxing practice and exercise include body punching bags and speed bags. Body punching bags are used to practice boxing moves such as body blows and uppercuts, whereas speed bags develop a boxer's reflexes and punching speed. In a gym setting, body punching bags and speed bags may be mounted separately some distance apart. This renders it difficult for a user to train on the body bag and the speed bag simultaneously.

Therefore, a punching bag assembly is needed which is capable of supporting a body punching bag and a speed bag in a desired proximity to each other.

SUMMARY

The present disclosure is generally directed to a punching bag assembly. An illustrative embodiment of the punching bag assembly includes a support stand having a pair of spaced-apart leg assemblies and a support frame carried by the leg assemblies, a body punching bag assembly carried by the support frame and having a body punching bag and a speed bag assembly having a speed bag carried by the support frame generally adjacent to the body punching bag assembly. The body punching bag assembly and the speed bag assembly are selectively positional with respect to each other along the support frame.

BRIEF DESCRIPTION OF THE DRAWINGS

The disclosure will now be made, by way of example, with reference to the accompanying drawings, in which.

DETAILED DESCRIPTION

Figure 1:
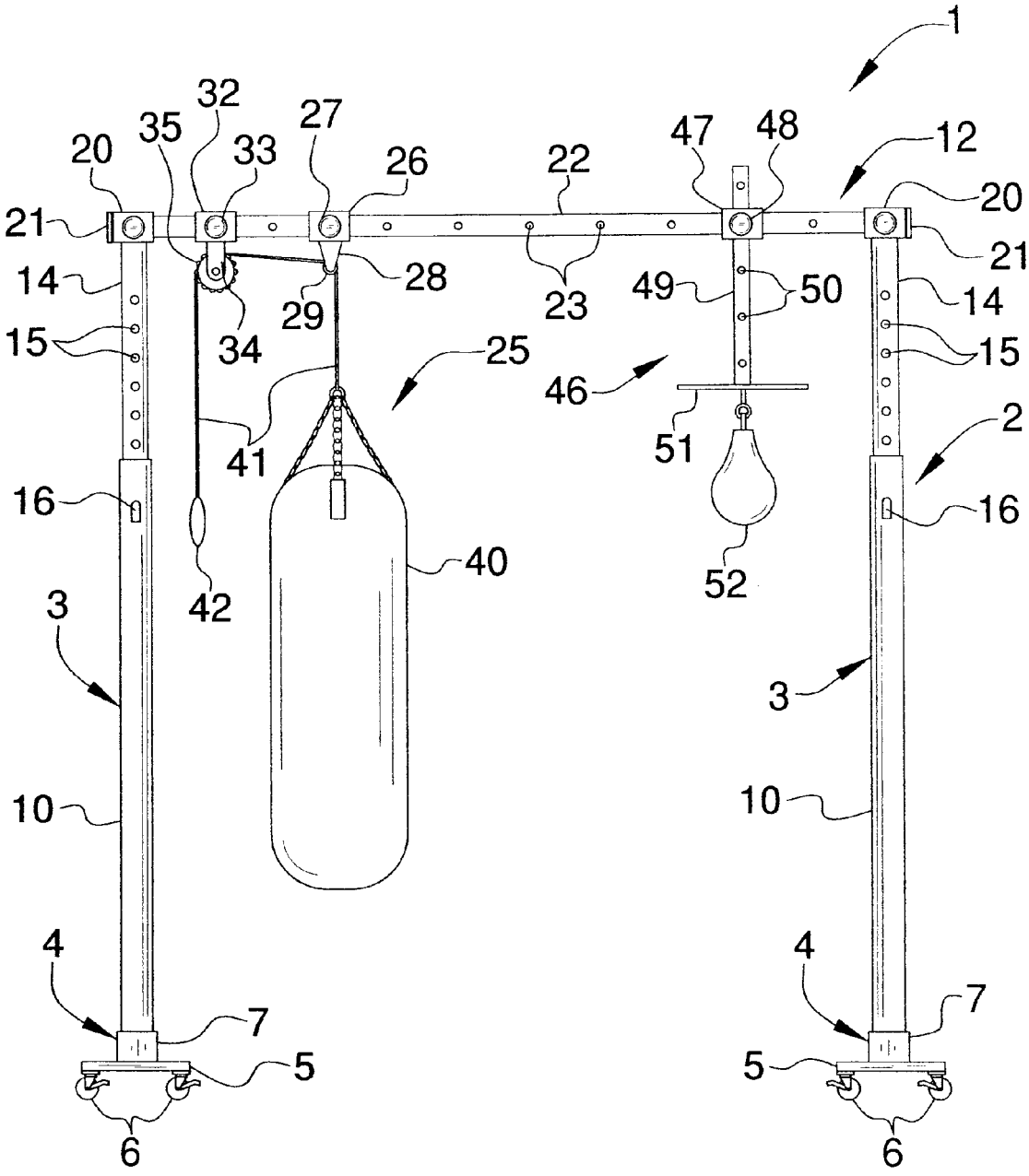
FIG. 1 is a front view of an illustrative embodiment of the punching bag assembly.
Figure 2:
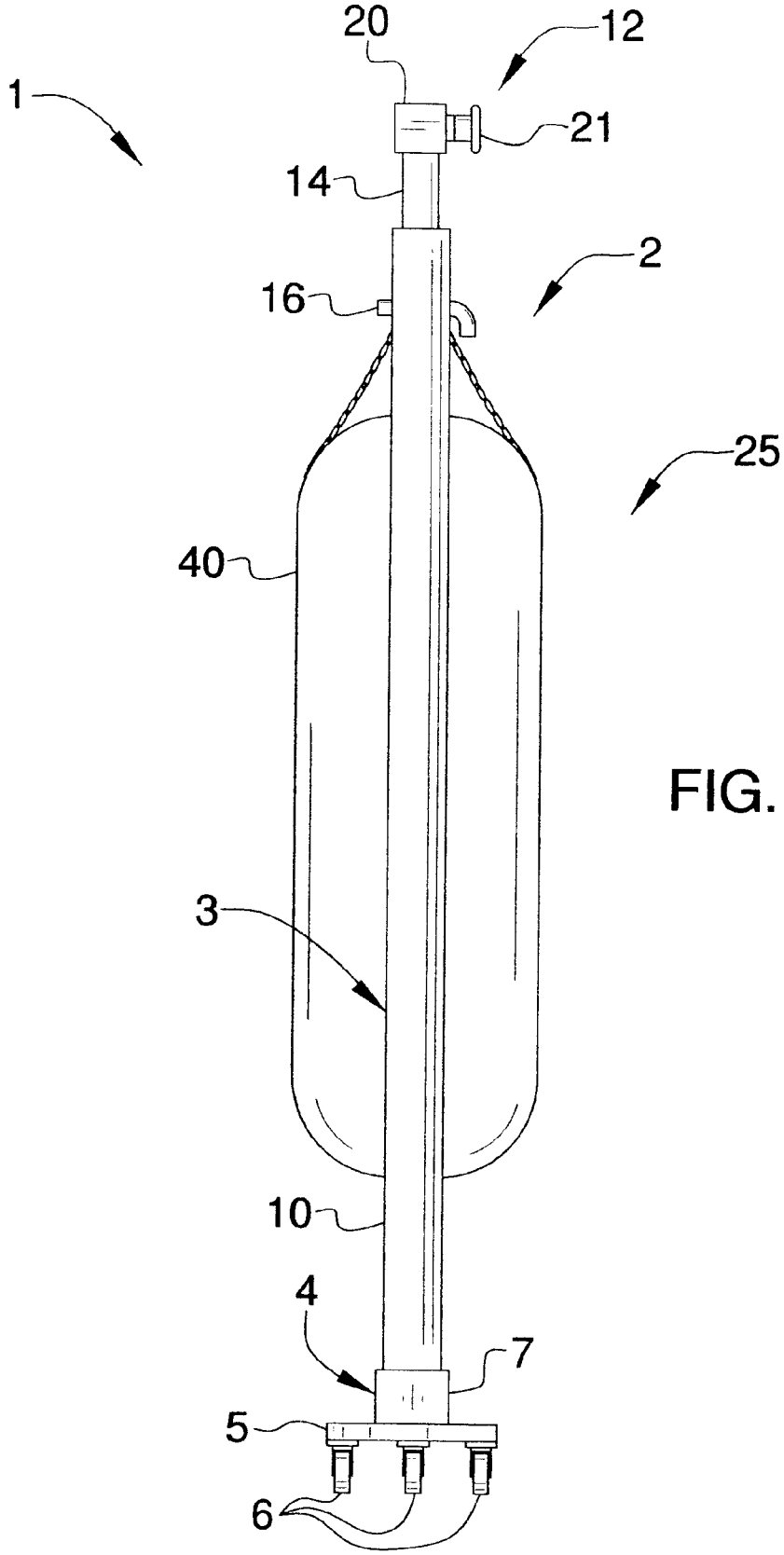
FIG. 2 is a side view of an illustrative embodiment of the punching bag assembly.
Figure 3:
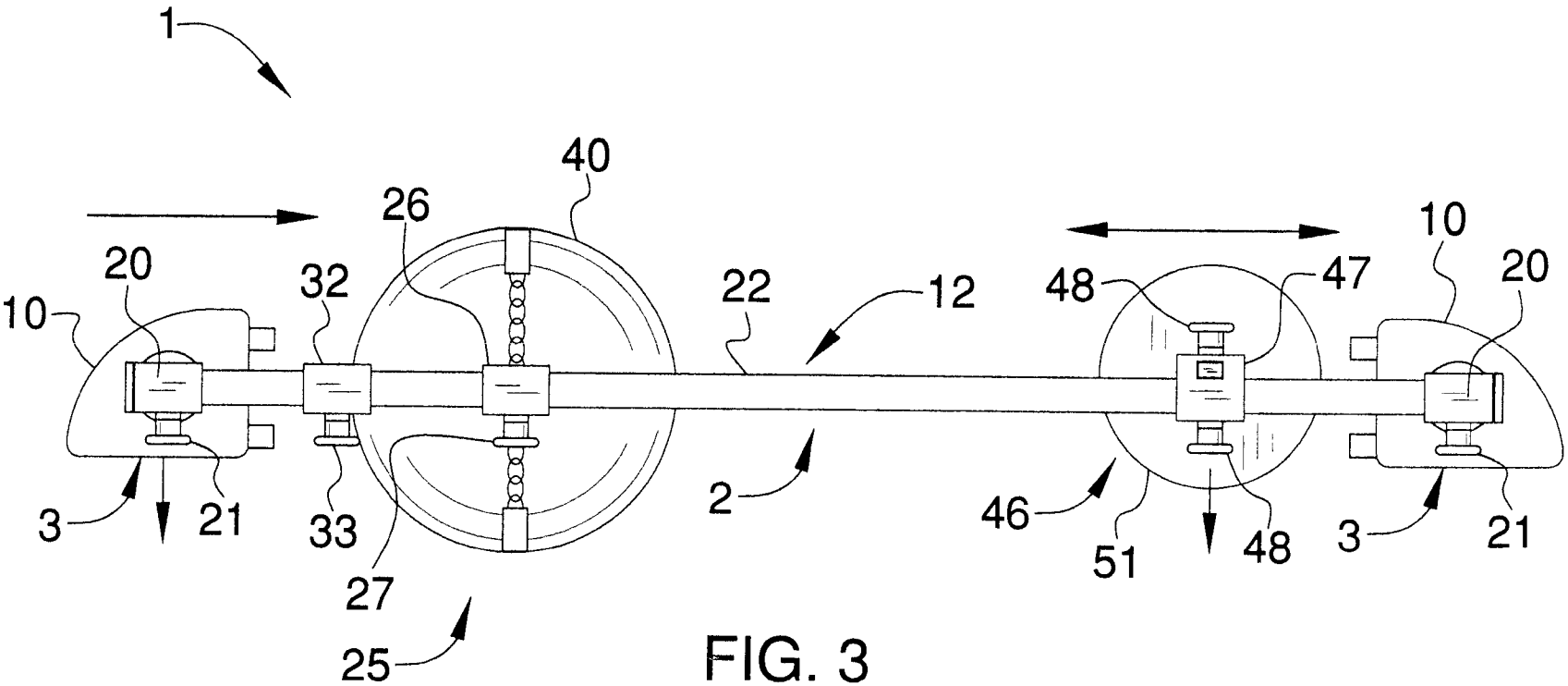
FIG. 3 is a top view of an illustrative embodiment of the punching bag assembly, illustrating positional adjustment of a body punching bag and a speed bag assembly on a support frame.
Figure 4:
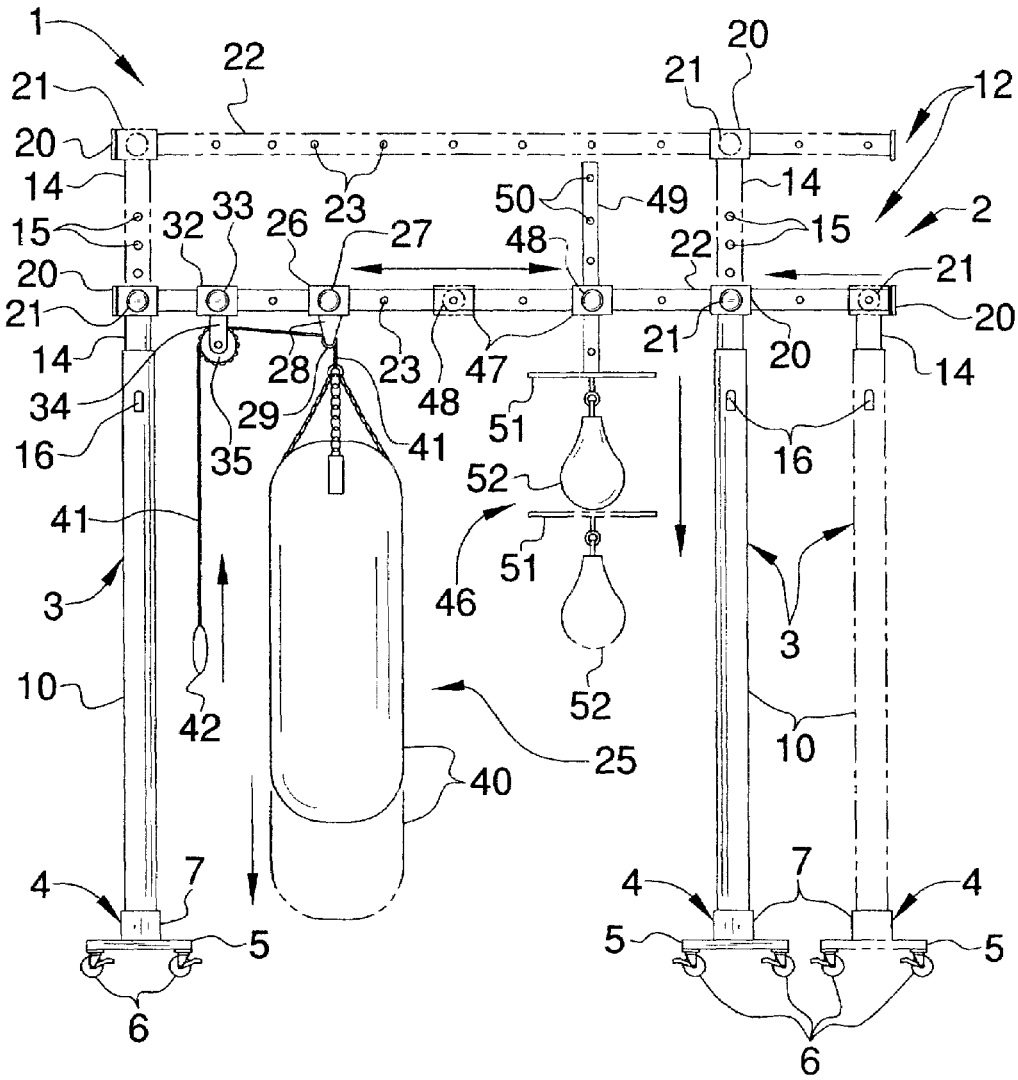
FIG. 4 is a front view of an illustrative embodiment of the punching bag assembly, illustrating height and width adjustment of a support frame of the punching bag assembly.

Referring to the drawings, an illustrative embodiment of the punching bag assembly is generally indicated by reference numeral 1. The punching bag assembly 1 includes a support stand 2. As shown in FIGS. 1, 2 and 4, the support stand 2 may have a pair of spaced-apart leg assemblies 3 and a support frame 12 which is selectively extendable from the leg assemblies 3. Each leg assembly 3 includes a pedestal 4 which may include a pedestal platform 5, multiple pedestal wheels 6 provided on the pedestal platform 5 and a pedestal collar 7 which extends from the pedestal platform 5. The pedestal wheels 6 of the pedestal 4 may be castor-type wheels, for example. A frame receptacle 10 extends from the pedestal collar 7 of the pedestal 4.

The support frame 12 of the support stand 2 includes a pair of spaced-apart vertical frame members 14 which are telescopically extendable from the frame receptacles 10 of the respective leg assemblies 3. Each vertical frame member 14 can be selectively extended from the corresponding frame receptacle 10 and locked at a selected height by, for example, extending a frame adjustment pin 16 through a pin opening (not shown) provided in the frame receptacle 10 and into a selected one of multiple spaced-apart frame adjustment openings 15 provided in the vertical frame member 14.

The support frame 12 of the support stand 2 further includes an elongated cross member 22 which extends between the vertical frame members 14 of the respective leg assemblies 3. As shown in FIG. 4, each leg assembly 3 may be horizontally adjustable along the cross member 22 according to the knowledge of those skilled in the art. In some embodiments, a pair of frame carriages 20, each having at least one spring-Loaded pin 21, is slidably mounted along the cross member 22. Multiple carriage adjustment openings 23 are provided in the cross member 22 at spaced-apart intervals. Each frame carriage 20 is provided on the upper end of a corresponding vertical frame member 14 of each leg assembly 3. Accordingly, each frame carriage 20 can be selectively slid along the cross member 22 until the spring-loaded pin 21 engages one of the carriage adjustment openings 23 to locate each leg assembly 3 at a selected point along the cross member 22. The spring-loaded pin 21 can be selectively disengaged from the carriage adjustment opening 23 to again facilitate movement of the frame carriage 20 along the cross member 22.

A body punching bag assembly 25 is mounted for selective displacement along the cross member 22 of the support frame 12. The body punching bag assembly 25 may include a body bag carriage 26 which is slidably mounted along the cross member 22. At least one spring-loaded pin 27 is provided on the body bag carriage 26 and is adapted to engage one of the carriage adjustment openings 23 in the cross member 22 and secure the body bag carriage 26 at a selected location along the cross member 22. A pair of spaced-apart pulley flanges 28 extends from the body bag carriage 26, and a pulley 29 is rotatably mounted between the pulley flanges 28.

A sprocket carriage 32 having at least one spring-loaded pin 33 is mounted for selective displacement along the cross member 22 of the support frame 12. A pair of spaced-apart sprocket flanges 34 extends from the sprocket carriage 32. A sprocket 35 is rotatably mounted between the sprocket flanges 34. An elongated punching bag cable 41 meshes with the sprocket 35 of the sprocket carriage 32 and is trained over the pulley 29 of the body bag carriage 26. The sprocket 35 of the sprocket carriage 32 imparts resistance to the punching bag cable 41. A cable handle 42 is provided on the end of the punching bag cable 41 which hangs from the sprocket 35 of the sprocket carriage 32. A body punching bag 40 is provided on the opposite end of the punching bag cable 41, which hangs from the pulley 29 of the body bag carriage 26. The height of the body punching bag 40 can be selected by pulling of the punching bag cable 41 in either direction along the sprocket 35. As shown in FIG. 4, the body punching bag assembly 25 can be selectively moved in either direction along the cross member 22 of the frame carriage 20 by moving the body bag carriage 26 and sprocket carriage 32 along the cross member 22.

A speed bag assembly 46 is mounted for selective displacement along the cross member 22 of the support frame 12. The speed bag assembly 46 includes a speed bag carriage 47 which is mounted for bidirectional displacement along the cross member 22 and has at least one spring-loaded pin 48. A generally elongated, vertical support member 49 is vertically adjustably mounted with respect to the speed bag carriage 47 of the speed bag assembly 46 according to the knowledge of those skilled in the art. In some embodiments multiple, spaced-apart adjustment openings 50 are provided in the vertical support member 49. Accordingly, a pin (not shown) is extended through a pin opening (not shown) provided in the speed bag carriage 47 and through a selected registering adjustment opening 50 provided in the support member 49. A bag plate 51 is provided on the lower end of the support member 49. A spring-loaded speed bag 52 is pivotally mounted on the bag plate 51 according to the knowledge of those skilled in the art. As shown in FIG. 4, the speed bag assembly 46 can be selectively moved in either direction along the cross member 22 of the frame carriage 20 by moving the speed bag carriage 47 along the cross member 22.

In typical use of the punching bag assembly 1, the cross member 22 of the support frame 12 is adjusted to the desired height by extension or retraction of the vertical frame members 14 with respect to the frame receptacles 10 of the respective leg assemblies 3 of the support stand 2 and locking using the frame adjustment pins 16. The body punching bag assembly 25 is placed at the selected position along the cross member 22 of the support frame 12 by sliding the body bag carriage 26 and the sprocket carriage 32 along the cross member 22 and locking the body bag carriage 26 and the sprocket carriage 32 in place. The speed bag assembly 46 is likewise placed at the selected position along the cross member 22 by sliding the speed bag carriage 47 along the cross member 22 and locking the speed bag carriage 47 in place. The height of the body punching bag 40 can be selected by gripping the cable handle 42 and pulling on the punching bag cable 41. The height of the speed bag 52 can be selected by sliding the support member 49 with respect to the speed bag carriage 47 and locking the support member 49 in place. It will be appreciated by those skilled in the art that both the height and the proximity of the body punching bag 40 and the speed bag 52 with respect to each other can be selected to facilitate simultaneous training using the body punching bag 40 and the speed bag 52. The punching bag assembly 1 can be relocated to any desired location by rolling the pedestal wheels 6 of each pedestal 4 on a support surface (not shown).

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A punching bag assembly, comprising:

a support stand having a pair of spaced-apart leg assemblies and a support frame carried by said leg assemblies;

said support frame comprises a pair of spaced-apart vertical frame members carried by said leg assemblies, respectively, and a cross member carried by said vertical frame members, and wherein said body punching bag assembly and said speed bag assembly are carried by said cross member;

said body punching bag assembly comprises a body bag carriage carried by said cross member and wherein said body punching bag is carried by said body bag carriage;

said body punching bag assembly further comprises a sprocket carriage carried by said cross member and a sprocket carried by said sprocket carriage, and further comprising a punching bag cable engaging said sprocket of said sprocket carriage and said body bag carriage and wherein said body punching bag is carried by said punching bag cable;

a body punching bag assembly carried by said support frame and having a body punching bag;

a speed bag assembly carried by said support frame generally adjacent to said body punching bag assembly and having a speed bag; and wherein said body punching bag assembly and said speed bag assembly are selectively positional with respect to each other along said support frame.

2. The punching bag assembly of claim 1 wherein each of said leg assemblies comprises a pedestal and a frame receptacle carried by said pedestal, and wherein said support frame is carried by said frame receptacle.

3. The punching bag assembly of claim 1 further comprising a pulley carried by said body bag carriage and wherein said punching bag cable engages said pulley.

4. A punching bag assembly, comprising:

a support stand having a pair of spaced-apart leg assemblies and a support frame carried by said leg assemblies;

said support frame comprises a pair of spaced-apart vertical frame members carried by said leg assemblies, respectively, and a cross member carried by said vertical frame members, and wherein said body punching bag assembly and said speed bag assembly are carried by said cross member;

said body punching bag assembly comprises a body bag carriage carried by said cross member and wherein said body punching bag is carried by said body bag carriage;

said body punching bag assembly further comprises a sprocket carriage carried by said cross member and a sprocket carried by said sprocket carriage, and further comprising a punching bag cable engaging said sprocket of said sprocket carriage and said body bag carriage and wherein said body punching bag is carried by said punching bag cable;

a body punching bag assembly carried by said support frame and having a body punching bag;

a speed bag assembly having a speed bag carriage carried by said support frame generally adjacent to said body punching bag assembly, a support member carried by and adjustable with respect to said speed bag carriage and a speed bag carried by said support member; and wherein said body punching bag assembly and said speed bag carriage of said speed bag assembly are selectively positional with respect to each other along said support frame.

5. The punching bag assembly of claim 4 wherein each of said leg assemblies comprises a pedestal and a frame receptacle carried by said pedestal, and wherein said support frame is carried by said frame receptacle.

6. The punching bag assembly of claim 4 further comprising a pulley carried by said body bag carriage and wherein said punching bag cable engages said pulley.

* * * * *